United States Patent [19]

Schwing

[11] Patent Number: 4,730,934

[45] Date of Patent: Mar. 15, 1988

[54] MOBILE MIXER, PREFERABLY HAVING COUNTERROTATIONAL EMPTYING, FOR BUILDING MATERIALS, IN PARTICULAR CONCRETE

[75] Inventor: Gerhard Schwing, Herne, Fed. Rep. of Germany

[73] Assignee: Friedrich Wilh. Schwing GmbH, Fed. Rep. of Germany

[21] Appl. No.: 60,990

[22] Filed: Jun. 9, 1987

Related U.S. Application Data

[63] Continuation of Ser. No. 938,325, Dec. 2, 1986, abandoned, and Ser. No. 814,761, Dec. 30, 1985, abandoned.

[30] Foreign Application Priority Data

Dec. 28, 1984 [DE] Fed. Rep. of Germany ..... 84116485
Oct. 25, 1985 [DE] Fed. Rep. of Germany ..... 85113601

[51] Int. Cl.[4] ..... B28C 7/04; B28C 7/16

[52] U.S. Cl. ..... 366/40; 366/44; 366/59; 366/173; 366/180; 366/229

[58] Field of Search ..... 366/44, 40, 57, 59, 366/227, 228, 229, 167, 173, 180

[56] References Cited

U.S. PATENT DOCUMENTS

| | | | |
|---|---|---|---|
| 1,861,416 | 5/1932 | Jaeger | 366/44 |
| 1,866,688 | 7/1932 | Willard . | |
| 2,192,406 | 3/1940 | Ludington | 259/168 |
| 2,360,344 | 10/1944 | Hilkemeier | 366/40 |
| 2,436,959 | 3/1948 | Ekin | 214/83.32 |
| 2,687,286 | 8/1954 | Eickstaedt | 250/161 |
| 2,698,742 | 1/1955 | McCoy | 259/178 |
| 3,038,705 | 6/1962 | McDermott | 366/44 |
| 3,138,167 | 6/1964 | Fisher | 134/145 |
| 3,567,189 | 3/1971 | Buelow | 366/44 |
| 4,285,601 | 8/1981 | Miner | 366/173 X |
| 4,478,514 | 10/1984 | Hudelmaier | 366/59 X |

FOREIGN PATENT DOCUMENTS

| | | |
|---|---|---|
| 580490 | 7/1933 | Fed. Rep. of Germany . |
| 1054811 | 4/1959 | Fed. Rep. of Germany . |
| 2327172 | 12/1974 | Fed. Rep. of Germany . |
| 2838501 | 3/1980 | Fed. Rep. of Germany . |
| 2949026 | 7/1980 | Fed. Rep. of Germany . |
| 3026033 | 1/1982 | Fed. Rep. of Germany . |
| 2922447 | 11/1985 | Fed. Rep. of Germany . |
| 6516215 | 6/1967 | Netherlands . |
| 913724 | 12/1962 | United Kingdom . |
| 2002645 | 2/1979 | United Kingdom . |
| 257322 | 4/1970 | U.S.S.R. . |

*Primary Examiner*—H. Hampton Hunter
*Attorney, Agent, or Firm*—Kinney & Lange

[57] ABSTRACT

In a mobile mixer, preferably having counterrotational emptying, for building materials, in particular concrete, in a mixing drum (1) which, on its inner wall (9), has one or more flat elevators (11, 12) following a helix and extending from the closed drum base (2) to the drum opening (3), which elevators (11, 12) are driven about the drum axis during rotation of the mixing drum and push the building material to the front of the closed base (2) during transport and during mixing, with one or more flat sections (26, 27) which are helically curved about the mixing drum axis (4) being fixed for driving during the mixing drum rotation (5) in the mixing drum space enclosed by the elevators acting as mixing spirals (11, 12), which flat sections (26, 27) are arranged counterrotationally to the mixing spirals (11, 12) in such a way that, during the transport and during the mixing of the buiding material (13), they produce a counterflow in the building material filling core surrounded by the mixing spirals (11, 12). It is provided according to the invention that the flat sections (26, 27) start at the mixing drum base (2) and end in front of the mixing spirals (11, 12) and the mixing drum opening (3), and that the flat sections (26, 27) of the counterflow spirals (26, 27) are fixed to the elevators of the mixing spirals (11, 12) and via the mixing drum base (2) to the mixing drum wall (9).

34 Claims, 7 Drawing Figures

MOBILE MIXER, PREFERABLY HAVING COUNTERROTATIONAL EMPTYING, FOR BUILDING MATERIALS, IN PARTICULAR CONCRETE

This is a continuation of application Ser. No. 814,761, filed Dec. 30, 1985 (now abandoned) and a continuation of application Ser. No. 938,325, filed Dec. 2, 1986 (now abandoned).

BACKGROUND OF THE INVENTION

1. Field of the Invention

The invention relates to a mobile mixer, preferably having counterrotational emptying, for building materials, in particular concrete, according to the preamble of claim 1.

2. Description of the Prior Art

The mobile mixer according to the invention transports a building material charge in the mixing drum and thoroughly mixes this charge during transport by the rotation of the mixing drum. Apart from consisting of concrete, the building material can also consist of mortar, with lime mortar, cement mortar and fire-clay mortar also being considered in addition to wall mortar and plaster mortar. Considered generally, these building materials consist of a special dry mixture which, apart from the aggregates or sand and the admixtures, usually contain hydraulic, but also occasionally non-hydraulic cements, and of water. As soon as the water comes together with the cement, a chemical process starts in most cement types, which chemical process proceeds all the more quickly the higher the ambient temperature, with it being necessary in this process to take into account the released heat of hydration as an additional heat source. The mobile mixer according to the invention enables the mixing water to be added during the journey or at the application site of the building material on account of its intentionally mixing effect, which circulates the building material charge, the mixing water being added at a point in time which is more or less shortly before the building material is used at the building site, so that the mobile mixer can transport the dry mixture and can thoroughly mix the latter with the mixing water.

The design of the mixing drum in which the mobile mixer according to the invention transports the building material, because of the firmly arranged, spiral elevators on the inner wall of the mixing drum, ensures a simple construction of this device, which, depending on the direction of rotation of the mixing drum, draws the building material inwardly about its center axis or delivers it outwardly through the mixing drum opening opposite the closed mixing drum base.

The invention relates inter alia to mixing drums which are mounted at an inclined angle on, for the most part, road vehicles, designed as trucks or truck platforms, in such a way that their opening through which the building material is fed or delivered is located at the top and their closed base is located at the bottom. According to the invention, if the building material has to be transported through narrow areas, as occur, for example, in tunnel construction, the mixing drum is also constructed with a horizontal arrangement, for example on a track bogie of the mixing drum axis. In this case, the shell of the mixing drum can have a number of manholes arranged next to one another between the mixing drum base, which are closed with a removable lid, and the mixing drum opening, which number of manholes depends on the length and the mixing drum diameter, through which manholes the base is accessed when the lid is opened and the building material charge is put in. In these mobile mixers, the opening of the mixing drum is often used to receive the building material from a mixing drum connected on the input side and to have it run through a mixing drum connected on the output side.

In known mobile mixers of the type described, a helical elevator usually made of flat bar steel, is provided above the drum base. It exerts a driving effect on the building material, which driving effect can lead to considerable compression in the building material charge core surrounded by the elevators, which building material charge has been filled into the mixing drum for transport.

In slightly moist concrete in particular, this stops the mixing action, which leads to considerable deterioration of the building material.

For this reason, it is also known (German Offenlegungsschrif No. 2,949,026), to mount in the drum center a pipe which rotates with the drum center and in which a spiral is fixed which rotates in the opposite direction to the outer mixing spiral. The pipe ends above the drum base and beneath the drum opening. However, the counterflow generation intended therewith in the core of filling in the drum, which counterflow loosens the accumulation of building material on the drum base to restart the mixing action, does not occur. On the contrary, the pipe prevents mixed material, carried upward by the outer spiral in the course of a drum rotation, from being able to freely fall far enough downward. Therefore, the intended free-fall mixing does not take place or takes place only inadequately. Moreover, the narrow cross section of the passage of the pipe restricts the quantity of mixed material to such a large extent that such mixers are unimportant in practice.

If the procedure is then adopted of adding most of the mixing water or its total quantity to the building material mixture before the charge to be transported is filled in order to improve the mixability compared with the dry mixture, no substantial improvement is achieved. However, the transport of such a largely finished building material has the further disadvantage that it threatens to freeze at low ambient temperatures and experiences premature hardening at high ambient temperatures even during transport and during any waiting time on the building site if expensive counter-measures are not taken to alleviate or avoid completely the deterioration consequently caused in the building material.

Since the movements of the building material charge in the mixing drum are also inadequate, because of the described effects of the spiral elevations and the short counterrotating spiral pieces in the space between the elevators, the above mentioned building material deterioration occurs even at favorable outside temperatures in spite of a rotating mixing drum during prolonged transport and waiting times. In may types of mobile mixers, however, in particular in the types of mobile mixers described above which are provided for tunnel construction, even the rotation of the mixing drum causes considerable difficulties, since, inter alia, compressed-air drives are provided for tunnel construction for safety reasons in mobile mixers for this purpose.

In mobile mixers having the mixing drum arrangement mentioned which is inclined at an angle, as are provided in most of the highway transport vehicles, it is also known to provide a positive-mixing device to avoid the above mentioned difficulties, which positive-mixing device is provided with a drive which is separated from the mixing drum drive and is constructed on the outside in front of the mixing drum base. The positive-mixing device itself consists of a short shaft which is arranged on the mixing drum axis and on which are fixed several mixing vanes. These act beneath the filling line of the mixing drum, which filling line, for reasons of economy, in order to exhaust the capacity of the mixing drum, runs from the lower edge of the discharge opening, for example at an angle of 25 degrees, up to the upper inner wall, on to the lower part of the charge, thus, tightly filling the mixing drum above the mixing drum base. These mixing blades are intended to produce a radial and axial flow of the building material into the compressed building material core described. Such a device does in fact improve the mixing action and consequently also enables the dry building material to be transported and the mixing water to be added outside the mixing plants from which the building material is delivered to the mobile mixers.

On the other hand, mobile mixers made in this way prove to be exceptionally complex designs which, therefore, either cannot be applied at all to certain mobile mixers, such as, for example, the mobile mixers described for tunnel construction, or create numerous sources of breakdown because of their complicated construction and accordingly are difficult to maintain. In addition, the mixing action is also unsatisfactory. Since the building material in question, in particular if it is concrete, contains coarse aggregate materials to a large extent more or less, the tools of the positive mixer must be protected from possible damage caused by jammed constituents of the building material mixture. This can only be done if an appropriately large intermediate space is maintained between the positive-mixing device and the elevations of the drum shell, in which intermediate space the coarse constituents can turn aside, but in which on the other hand, positive mixing action is not achieved either.

SUMMARY OF THE INVENTION

In contrast, the object of the invention is to create in simple manner, for a mobile mixer of the type known from the printed matter described above, a general construction, that is, a construction which can be applied to the different types of mobile mixers described, which construction ensures that the building material charge is completely and thoroughly mixed and moved by the mixing drum, even in the case of slightly moist concrete, and at the same time produces an adequate intermixture.

This object is achieved according to the invention by the characterizing feature of claim 1. Expedient embodiments of the invention are the subject matter of the subclaims.

In the case of the invention, a building material mixture flow which is directed toward the closed mixing drum base is in fact produced in an outer-jacket area of the building material charge during the mixing drum rotation provided for the transport, which flow is reversed inwardly via the mixing drum base and runs in the building material mixture core enclosed by the elevations of the mixing drum shell toward the mixing drum opening. This counterflow movement of the described part of the building material charge through the mixing drum receives its energy from the flat sections of the concentrical inner counterflow spirals as a result of their pitch which runs in the opposite direction to the mixing spirals fixed on the drum shell. However, since these flat sections, at the open end of the mixing drum, do not reach the ends of the mixing spirals forming the elevators of the mixing drum shell, but terminate in front of these mixing spirals and the mixing drum opening, the counterflow transporting action stops in time, so that the building material cannot emerge through the mixing drum opening but it seized again by the elevators of the mixing drum shell and deflected in their transport direction. In the case of the invention, the known free-fall mixing is superimposed on this action, because the fixing of the inner counterflow spirals does not offer any resistance or only offers a negligible resistance to this free-fall mixing, which resistance, in addition, advantageously also depends on the quantity delivered each time in the counterflow. The overall construction of the new mobile mixer is also no more complicated, but on the other hand, offers the possibility of applying this mobile mixer construction to horizontal mixing drums as have to be used in the described mobile mixers for tunnel construction. However, the counterflow spiral not only produces an axial movement component but also a radial movement component, because this movement, in practice, is not impaired by the installed parts. These are nevertheless adequate to secure the counterflow spiral in the mixing drum in such a way that it is driven by the latter against the resistance of the building material mass and at the same time is not deformed.

During the synchronous emptying through the mixing drum base opening or the counterrotational emptying through the constantly free mixing drum opening opposite the mixing drum base, complete emptying of the mixing drum is ensured, is spite of the reversal in the flow direction in the core of the building material charge as a result of the counterflow mixing spirals, because the counterflow mixing spirals also produce a radial movement of the building material mixture and therefore convey the building material mixture outward in this rotational direction into the mixing spirals which then convey the building material along the mixing drum wall and outward through the mixing drum opening.

The mobile mixers according to the invention, because of the design of their mixing drum, ensure a mixing action which hitherto could only be achieved with stationary mixing machines, although it is not necessary to embody either their dimensions, which are large in comparison with the contents, or additional drives, because they are standard in positive mixers. The capacity of the mobile mixers according to the invention therefore essentially corresponds to the capacity of conventional mobile mixers of the same dimensions. Yet according to the invention, the building material mass is prevented from moving only about the axis of the mixing drum inside the mixing drum shell when the mixing drum is running. When the mixing drum is filled, the invention also has the advantage that the mobile mixer can be used as a mixing machine; therefore mobile mixers eliminate the disadvantageous effects of extreme outside temperatures on the quality of the building material in that only the dry mixture of building material can be transported, which dry mixture is then diluted and mixed with the mixing water just shortly before it is used.

The delivery capacity of the counterflow spirals is preferably arranged such that it results in an axial speed of the core of the building material mass, which speed approximately corresponds to the speed which the mixing spirals produce in the opposite direction in the jacket of the building material mass. It is therefore expedient to embody the features of claim 2.

On the other hand, it is advisable, by means of a compact design to consider the comparatively narrow space in which the core of the building material mass is located. The features of claim 3 are provided for this purpose.

For conventional mobile mixers, in particular of the type described at the beginning having a mixing spiral fixed to the drum, but also for the new type of mobile mixers described thus far, especially when dry mixtures of the building material are transported by means of the vehicle, which dry mixtures are diluted and mixed with the mixing water just before use, the problem frequently occurs that on the one hand the mixing water does not mix or does not mix quickly enough with the other constituents and in addition that the stationary parts of the building material intended for movement provides too much resistance. The invention avoids this according to claim 4 in that nozzles for ejecting water are arranged inside the mixing drum, which nozzles are connected to one another via pipelines and are connected to a pump arranged outside the drum, with the nozzles being aligned in such a way that their apertures lie freely in the mixing flow path during the mixing operation of the drum. This ensures on the one hand a good thorough mixing of the building material charge and on the other hand a uniform distribution and thorough mixing of the building material charge with the mixing water.

In a preferred embodiment of the invention, it is provided that the pipelines follow the contour of the flat section and merge at their ends in each case in a straight pipe piece extending in a plane perpendicular to the drum longitudinal axis, with one of the pipe pieces being connected to a feed line which leads to the pump via a rotary transmission coupling in one of the drum end faces.

To protect the nozzles from the abrasive building material and as a further additional measure for preventing clogging of the nozzles, the latter are covered with caps of a hollow shape made of an elastic or elastomer material in which slot-shaped openings are provided and which are wear-resisant because of their material.

A modified embodiment of the invention provides that nozzles for the mixing water are provided on the mixing spiral and faces pointing towards the drum center. In this embodiment, the counterflow spirals have been dispensed with.

Although as a result of the combination of mixing spirals, counterflow spirals and water ejecting nozzles an optimum thorough mixing naturally takes place, preferably at the counterflow spirals, because genuine free-fall mixing takes place as a result of the counterflow spirals and the filling material is not only pressed against the drum base, this solution nevertheless offers considerable progress. Because of the uniformly distributed nozzles on the mixing spirals and the defined and concentrated mixing water delivery consequently made possible inside the drum, a loosening of the filling material pressed through the mixing spirals to the base is achieved, so that good, thorough mixing of the filling material and the filling material with the mixing water is nevertheless still achieved.

A further modification of the invention provides that the rotary transmission coupling has several channels, with it being possible for each channel to be pressurized with mixing water by a pump and with the channels being connected behind the rotary transmission coupling via individual lines to certain delivery nozzles. In this way, depending on the form, size and method of construction of the mixing drum, a specific or positively proportioned water addition is possible.

The mobile mixer can be designed in such a way that the mixing drum is mounted on the chassis of a transport vehicle at an upwardly inclined angle with the base located at the bottom and the opening located at the top, but it is also provided that the mixing drum is mounted horizontally on the chassis of a vehicle and the mixing drum base as well as the mixing drum opening can be closed with lids.

Such mobile mixers are used in particular in the concrete lining of tunnels. For this purpose, the mobile mixers are either short-coupled or long-coupled.

Long-coupling creates a spacing between the end faces of the mixing drums mounted on the vehicles, which ensures the necessary bend-negotiating characteristic of the train. In the case of short coupling, the feed and delivery openings which are in alignment with one another in the same longitudinal direction interlock, so that, when the mixing drums are rotating in the appropriate direction at the face, the concrete can be delivered from one mixing drum into the other. In this way, the train is emptied in continuous manner by the elevators arranged on the drum inner wall driving the building material through the delivery openings. The building material is filled outside the tunnel. For this purpose, a further feature of the invention provides that the filling opening is arranged in the drum end wall on which filling funnel can be fixed, which end wall is opposite the end wall on the discharge side and which filling funnel extends with a chute into the filling opening. Hitherto, the building material was filled into the drum by the pre-mixed building material being fed into the mixing drum via several manhole openings arranged one after the other in the longitudinal direction on the mixing drum. However, this results in considerable disadvantages which on the one hand lead to an unfavorable degree of filling of the drum and on the other hand lead to an unfavorable building material quality. The unfavorable degree of filling results from approximately conical heaps forming beneath the manhole openings. If the heaps reach the manhole openings, the latter must first be closed and then the mixing drum must be rotated, so that a uniform, low filling level results. During this procedure, the mixer vehicle must be shunted beneath the mixing plant, so that each manhole opening can be used for filling the building material. All this takes considerable time and leads to a poor building material quality even when the mixing drum is filled.

To shorten the filling operation still further, which is of particular importance for the building material quality, a further feature of the invention provides that the filling funnel can be secured by conical projections arranged on the filling funnel with two or more likewise conical sleeves which are arranged on the chassis of the vehicle. Thus, the filling funnel need only be inserted into the sleeve and can simply be pulled out again after the filling operation. Time consuming assembly is dispensed with. Nevertheless, the filling funnel is reliably mounted.

BRIEF DESCRIPTION OF THE DRAWINGS

The details, further features and other advantages of the invention follow from the description below of embodiments according to the invention which are shown in the figures of the drawing, in which.

Figure 1:
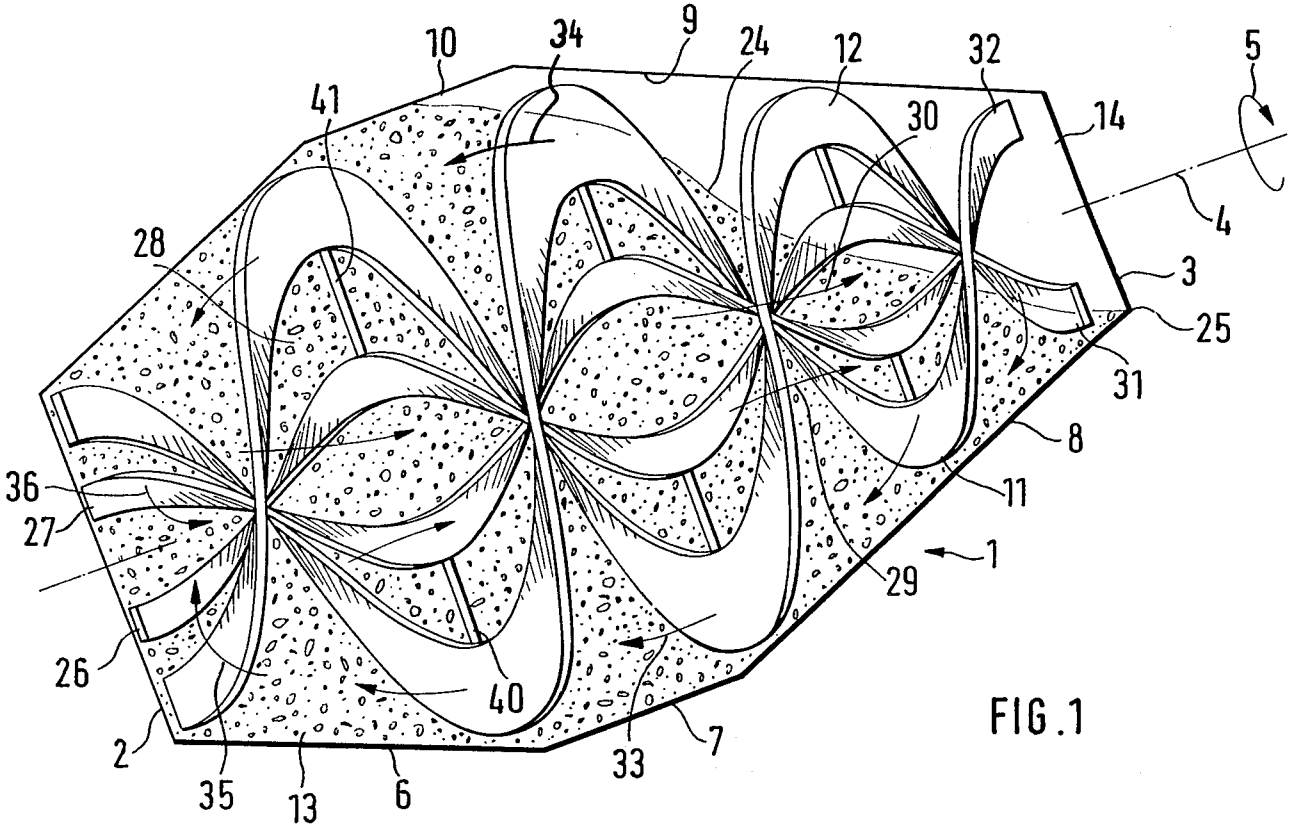
FIG. 1 shows a side view of a mixing drum according to the invention, as it is used in a highway transport mobile mixer, with the interior of the mixing drum itself being shown in order to illustrate the relationships during mixing.

Designated as 1 in the representation according to FIG. 1 is a pear-shaped mixing drum which has a closed base and, opposite the base 2, an opening 3 which does not have a lid and is therefore kept continuously open. The axis 4 of symmetry of the mixing drum illustrates that the latter is installed at an inclined angle, with the direction of rotation of the mixing drum being indicated by the arrow 5.

Figure 2:
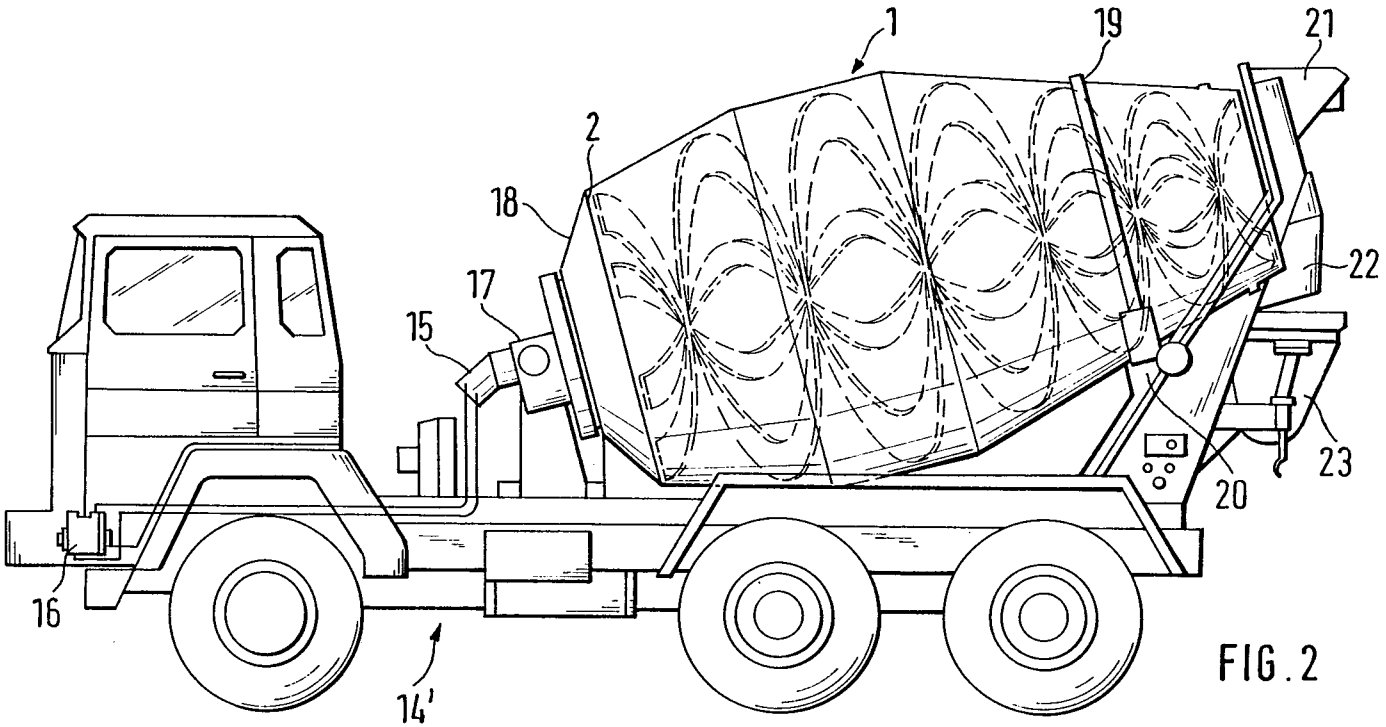
FIG. 2 shows a side view of a highway transport mobile mixer on which a mixing drum according to FIG. 1 is mounted.

The construction of the mixing drum provides a lower conical section 6, a cylindrical section 7 following thereafter, and a conical neck 8 which leads to the opening 3. Two mixing spirals 11 and 12 are fixed to the inner side 9 of the drum shell designated generally as 10. The mixing spirals are fixed in such a way that they are driven against the resistance of the building material mass 13 when the drum rotates in the direction of the arrow 5. The two mixing spirals 11 and 12, displaced in each case by a semicircle, have the same pitch and, generally considered, represent elevators on the drum shell 9 which protrude into the inner space 14 of the drum. If such a mixing drum according to FIG. 2 is constructed on a truck chassis 14', it generally has a capacity between 2.5 and 10 $m^3$. It can be rotated in two directions via a drive mechanism 17 by means of a hydraulic drive motor 15 which is fed by a built-in pressure generator 16. The drive mechanism 17 acts on the drum base 2 via a flange 18. Otherwise, the mixing drum sits with a track ring 19, fixed on its shell in the area of the neck 8, in a bearing 20 which is arranged such that it is fixed to the truck body. In front of the mixing drum opening is located a filling funnel 21, through which a building material mixture can be supplied to the drum 1. When the mixing drum 1 is driven against the direction of the arrow 5 in FIG. 1, the building material is delivered and flows via a chute 22, for example, into the pre-filling container 23.

The two mixing spirals 11 and 12 mounted on the inner side 9 of the drum shell 10 are designed as solid-web spirals. If the building material mixture is put into the drum via the filling funnel 21, the drum must be rotated in the direction of the arrow 5, so that the mixing spirals 11 and 12 can move the building material mixture into the inner space 14 of the drum. In the embodiment according to FIG. 1, this operation is aided by the upwardly inclined mounting of the mixing drum. For reasons of economy, the volumetric capacity of the drum is always fully used. The filling line 24 of the drum then runs from the lower edge 25 of the delivery opening at an incline of about 25 degrees up to the upper inner side of the mixing drum. Behind or below this filling line 21 the drum is tightly filled up to the head end, that is, in the direction of the drum base 2. Depending on the duration of transport or length of travel, it is necessary to keep the contents of the mixing drum moving so as not to allow the setting process to start if the building material has been filled together with the mixing water. For this purpose, the motor 17 rotates the mixing drum at a low speed in the direction of the arrow during the journey of the vehicle 14.

According to the representations in FIGS. 1 to 2, two flat sections curved helically about the mixing drum axis 4, for driving the building material during the mixing drum rotation are fixed in the mixing drum space enclosed by the mixing spirals 11 and 12. These flat sections start from the mixing drum base 2 and end in front of the mixing spirals 11 and 12 and the mixing drum opening 3. They are made counterrotational to the mixing spirals 11 and 12 and, like the latter, are so arranged as to be displaced by a semicircle in such a way that they act as counterflow spirals 26 and 27. That means, when the building material in the core 28 of the building material fill 13 is being mixed during rotation of the mixing drum in the direction of the arrow 5, which core is surrounded by the mixing spirals 11 and 12, a counterflow starting from the drum base is produced which is indicated schematically by the inner arrow pairs 29 and 30 in FIG. 1. The counterflow is directed toward the mixing drum opening 3, but ends beneath the ends of the mixing spirals 11 and 12, which ends are shown at 31 and 32. This is due to the fact that the two counterflow spirals 26 and 27 terminate approximately at the mentioned filling line 25 and, therefore, beneath the ends 31 and 32, for which reason the ends 31 and 32 can reverse the direction of the building material flow and the jacket of the building material fill is able to follow the arrows 33 and 34 which run along the drum wall toward the base. As soon as the building material particles following this outer flow have reached the base 2, their direction reverses again according to the arrows 35 and 36.

These counterrotational flows in the mixing drum prevent a compact building material mass from forming, particularly in the lower part of the mixing drum which is formed by the cone 6. On the contrary, the counterflow spirals 26 and 27 create an intensive circulation of the building material mass and therefore, immediately improve the distribution of the binder contained in the building material mixture, of the fine sand and of the various grain sizes of the admixture materials. This even takes place in the dry condition of the building material mass. When water is being added, uniform soaking is accelerated and intensified.

During the mentioned reversal of direction of rotation of the mixing drum 1, the full-web spirals 11 and 12 drive the building material mixture against the direction of the arrows 33 and 34 and convey it outward through the opening 3. At the same time, the mixed material slides off the counterflow spirals 26 and 27 as emptying of the mixing drum progresses until the building material core is loosened, the mass of which is likewise seized by the full-web spirals 11 and 12 and transported to the delivery opening 3.

Moreover, it follows from the representation of FIG. 1 that the counterflow spirals 26 and 27 have the same pitch as the mixing spirals 11 and 12. Moreover, the width of the flat sections forming the counterflow spirals 26 and 27 is less than the width of the elevators on the mixing drum wall 9, which elevators are formed by the mixing spirals 11 and 12.

The flat sections of the counterflow spirals 26 and 27 are fixed to the spirals 11 and 12 at several locations by means of rod-like supports 40 and 41. Moreover, in the lower area of the drum, the counterflow spirals 26 and 27 are fixed directly on the base 2 of the drum or on the adjoining drum wall.

Figure 3:
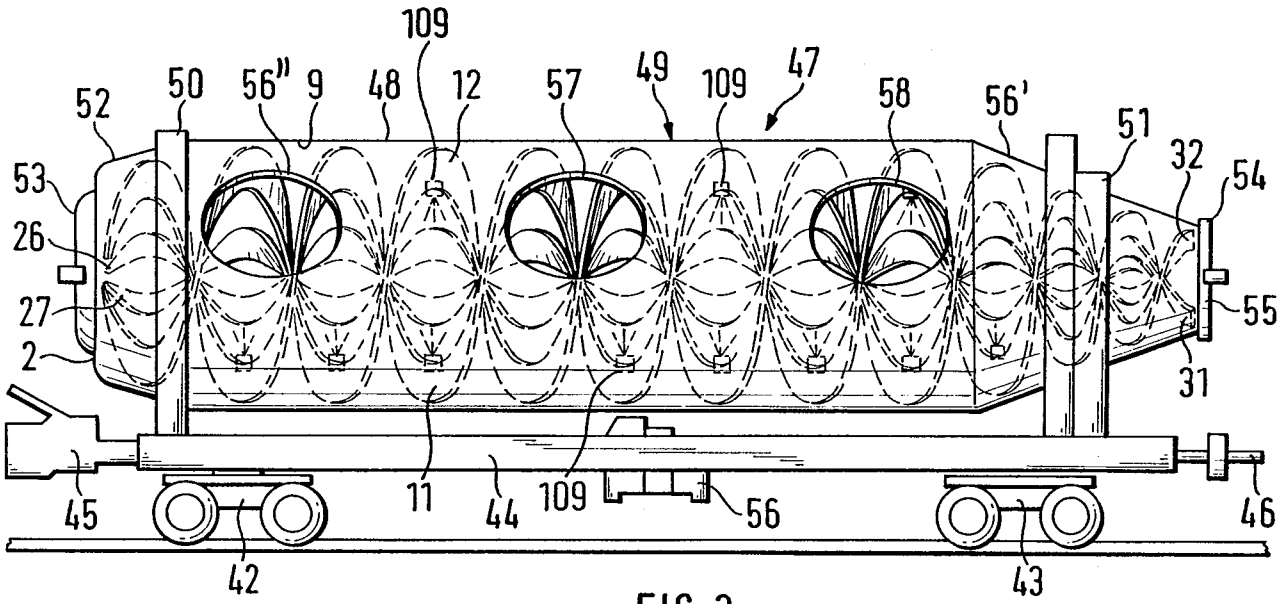
FIG. 3 shows a track-mounted mobile mixer according to the invention, as is used inter alia in tunnel construction.

The embodiment according to FIG. 3 is intended for tunnel construction. The chassis 44 of a low-loader wagon runs on track-mounted bogies 42 and 43, which wagon, at its front side and rear side, has couplings 45 and 46 for following or preceding transport wagons which correspond in design and in size to the mobile mixer 47 which is shown in FIG. 3.

The mobile mixer is essentially constructed from a mixing drum 48 which has a cylindrical shell 49 over the greater part of its length and is supported with track rings in stationary bearings 50 and 51. The base 52 of the mixing drum is provided with a lid 53. The mixing drum opening 54 opposite the base is in turn closed by a lid 55. A conical section 56' of the mixing drum forms an extended transition from the cylinder shell 49 to the opening 54.

Such mixing drums are normally about 3 to 7 meters long. They can be driven by a motor which is indicated at 56, but in many cases have to be designed as a compressed-air drive because of the special tunnel conditions.

The building material is fed into the drum 47 beneath a mixing station in front of the tunnel through manhole openings shown at 56" to 58. Depending on the length, such drums generally have one to three manholes which are brought in order one after the other beneath a gravity pipe then the manhole is closed with a lid. Moreover, mobile mixers 47 of the type which can be seen from FIG. 3 are usually coupled up to several mobile mixers and form a train which transports a larger building material quantity over tracks to the installation site in the tunnel. Depending on the length of the travelling track, circulation of the building material is required to keep it fresh. If a separate power source is not carried along on the train, the train must stop along the way in order to start the compressed-air motors for the drum rotation at a supply point.

The two mixing spirals 11 and 12 are in turn provided in the drum 47, which mixing spirals 11 and 12 are fixed to the inner side 9 of the mixing drum 47. They extend from the drum base 2 to the opening 54. Moreover, two counterflow spirals 26 and 27 are provided which, in turn, terminate beneath the ends 31 and 32 of the mixing spirals 11 and 12 and, therefore, also stop short of the opening 54.

During the transport of the building material filled through the three manholes 56" to 58, the mixing spirals 11 and 12 push the building material inside the drum against the drum end which is identified by the base 2 and is closed by the lid 53 just as the drum opening 54 is closed by the lid 55. The build-up of the building material on the base 52 is prevented by the action of the counterflow spirals 26 and 27 which is described in conjunction with the embodiment according to FIGS. 1 and 2.

The mixing action which occurs in the described embodiment of the mobile mixer 27 and which corresponds to that of a free-fall mixer is new; since the counterflow spirals 26 and 27 convey the building material in the opposite direction, they result in a clearing out and return movement of the building material in the core which is enclosed by the mixing spirals 11 and 12. Consequently, clearance spaces are created which enable the building material to be thoroughly mixed in free-fall.

Figure 4:
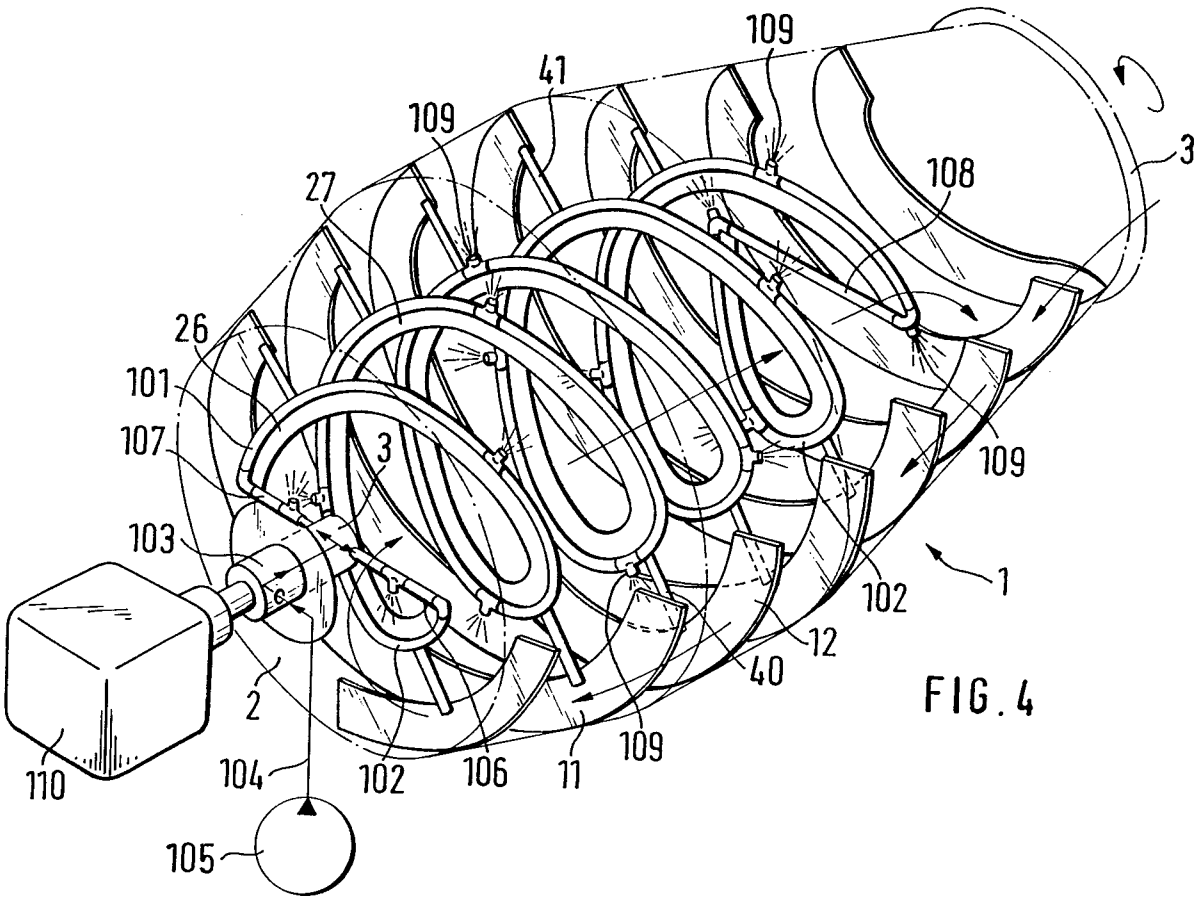
FIG. 4 shows a mixing drum according to FIG. 1 having a device for supplying the mixing water (rotary transmission coupling through in the drum base)
Figure 5:
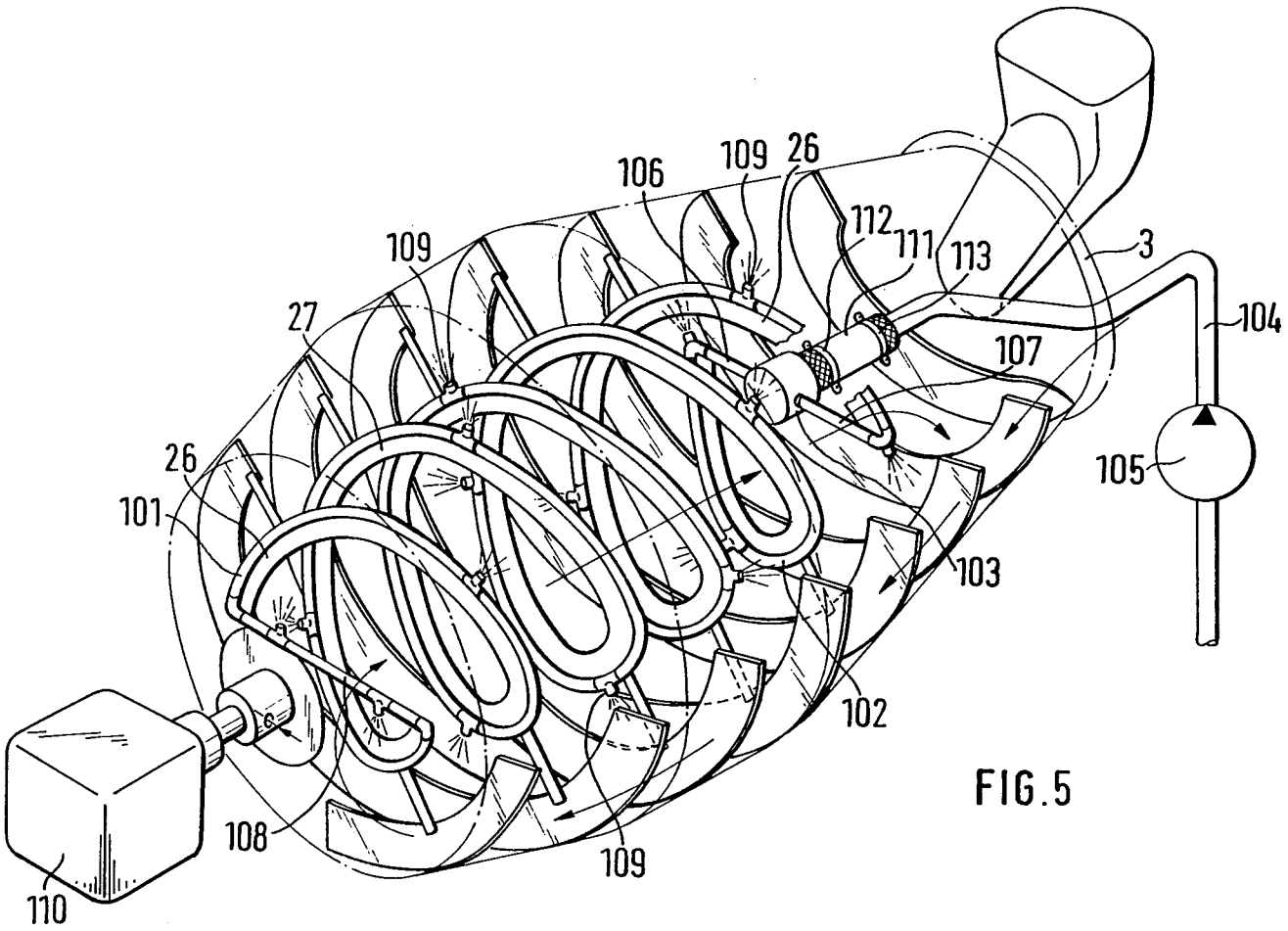
FIG. 5 shows a mixing drum according to FIG. 4 having a water feed through the drum opening.

In FIGS. 4 and 5, the same parts as in FIGS. 1 to 3 are provided with the same reference numerals. The counterflow spirals 26 and 27, on their edge directed toward the drum wall, are provided with pipes 101 and 102 which follow the path of the counterflow spirals 26 and 27. In the base 2 of the drum 1, a rotary transmission coupling 103 is provided, through which a pipeline 104 leads from a pump 105 to two pipe pieces 106 and 107 which emerge radially out of the rotary transmission coupling. The pipe pieces 106 and 107 lead into the pipelines 101 and 102 at their ends facing away from the rotary transmission coupling. The pipelines 101 and 102 are connected to one another by means of another pipe piece 108 on their end on the drum opening side. Nozzle-shaped delivery openings 109 are arranged in a uniformly distributed manner over the length of the pipelines 101 and 102. The nozzles 109 are arranged in such a way that they are located in the mixing flow path during the mixing operation, so that the free delivery of the mixing water is ensured. The drum drive is designated with reference numeral 110 and is merely shown schematically.

In FIG. 5, a mixing drum according to FIG. 4 is shown in which the mixing water is supplied from the pump 105 via the line 104 through the drum opening 3 to the pipe pieces 106 and 107 and to the nozzles 109. The line 104 is connected to the rotary transmission coupling 103 by means of a sleeve 111 which is made of elastic material. The sleeve 111 is firmly held and seated by means of band clamp fittings 112 and 113.

Figure 6:
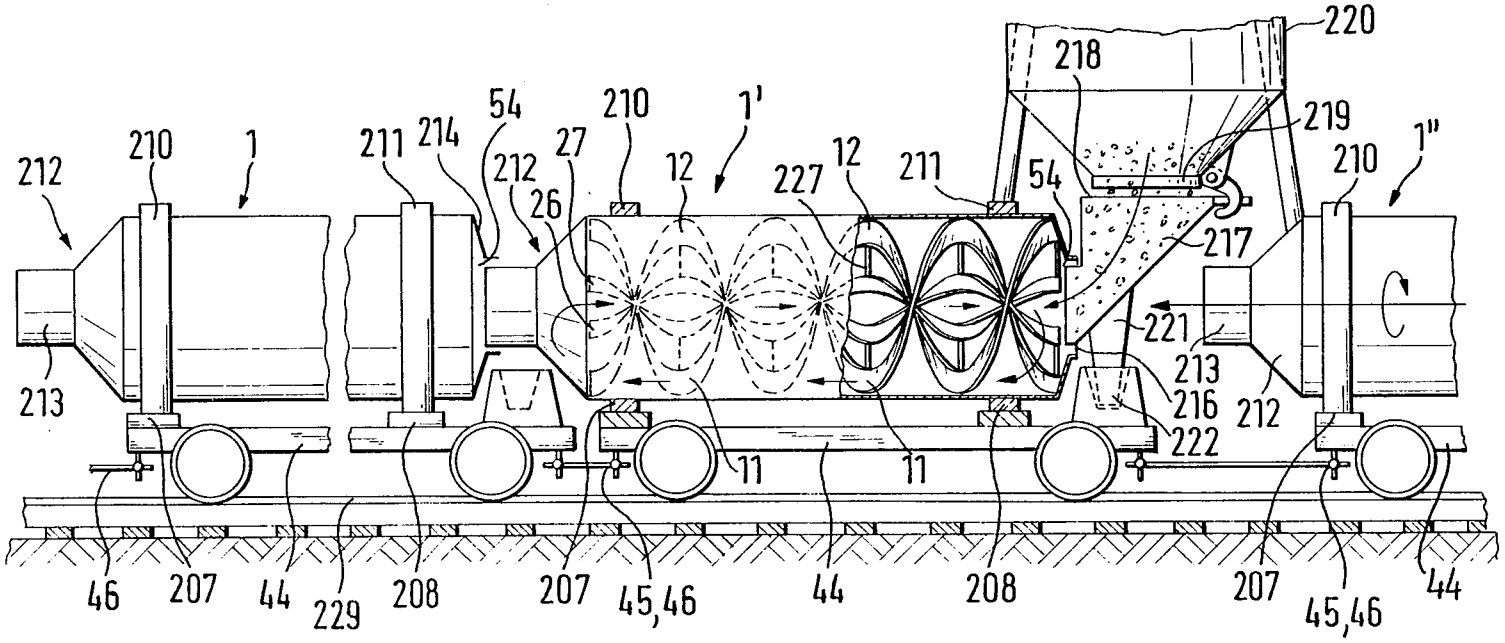
FIG. 6 shows a track-mounted mobile mixer according to FIG. 3 having a lateral filling opening.

A building material train made up of several mobile mixers is shown in FIG. 6. Each mobile mixer consists of mixing drums 1, 1' and 1" which of which is rotatably mounted on bearings 207 and 208 on a chassis 44. At the same time, the drive for the rotary movement of the drums 1 to 1" is accommodated in the bearings 207 and 208. The drums 1 to 1" are guided in guides 210 and 211 which annularly enclose the drums 1 to 1". As follows from the drawing, each drum 1 to 1" is arranged horizontally on its respective chassis 44. The front side 212, the left hand side in the drawing, of each drum 1 to 1" is made in the shape of a truncated cone. A hollow cylinder-shaped end 213 adjoins the truncated cone 212. The hollow cylinder-shaped end 213 of the end wall 212 is closed during the filling operation, as is shown in the center of the figure. The opposite end wall 214 also has an available opening 54 which, however, is not closed. The chute 216 of a filling funnel 217 extends into the opening 54, the upper opening 218 of which filling funnel 217 extends beneath the discharge opening 219 of a stationary mixing device or a concrete silo 220. Conical projections 221 are arranged on the filling funnel 217 in its lower area, of which projections 221 only one is shown in the drawing. The filling funnel is mounted and locked with these projections 221 in corresponding conical sleeves 222. In the inside of the mixing drums 1 to 1'', helical elevations 11 and 12 are fixed to the drum shell. They extend from one end wall to the opposite one. In the area of the center axis of the drums 1 to 1'', helical flat sections 26 and 27 are arranged which extend from one front side 212 of the drums 1 to 1'' to the opposite front side 214. The flat sections 26 and 27 are coiled counterrotationally to the elevations 11 and 12 and are connected to the latter by struts 227. The spirals formed by the flat sections 26 and 27 have a diameter of about 1½ to ⅓ times the diameter of the drum 1 to 1''. The mobile mixers are coupled to one another by couplings 45 and 46 and can be moved on rails 229.

The mixing drum 1' is filled with building material from the silo 220 via the filling funnel 217 and the lateral opening 54. The drum 1 rotates during this procedure. The helical elevations 11 and 12 drive the said building material to the opposite front side 212 of the drum 1'. Here, the building material is seized by the flat profiles 26 and 27 and conveyed back in the opposite direction as a result of their counterrotational coiling. At the end of the flat sections, the building material falls downwards and is again seized by the elevators 11 and 12 and so on. Once the drum 1' is filled, the filling funnel 217 is removed and the following mobile mixer is moved up to the drum 1' in such a way that the hollow cylinder-shaped end 213 of the drum 1'' extends into the filling opening 54 of the drum 1' and closes the latter. The train is then moved until the conical sleeve 222 on the chassis 44 of the mobile mixer for the drum 1'' comes beneath the silo 220. The filling funnel 217 is then inserted and the drum 1'' can be filled. Once all of the mobile mixers belonging to the train are loaded, the train travels to the application site, for example in the the tunnel, with the mixing drums rotating. Here, the lids in the hollow cylinder-shaped ends 213 of the drums 1 to 1'' are removed and the building material is discharged by means of the elevators 11 and 12 as a result of the rotary movement of the drums 1 to 1'', with the drums 1 to 1'' emptying continuously from right to left.

Figure 7:
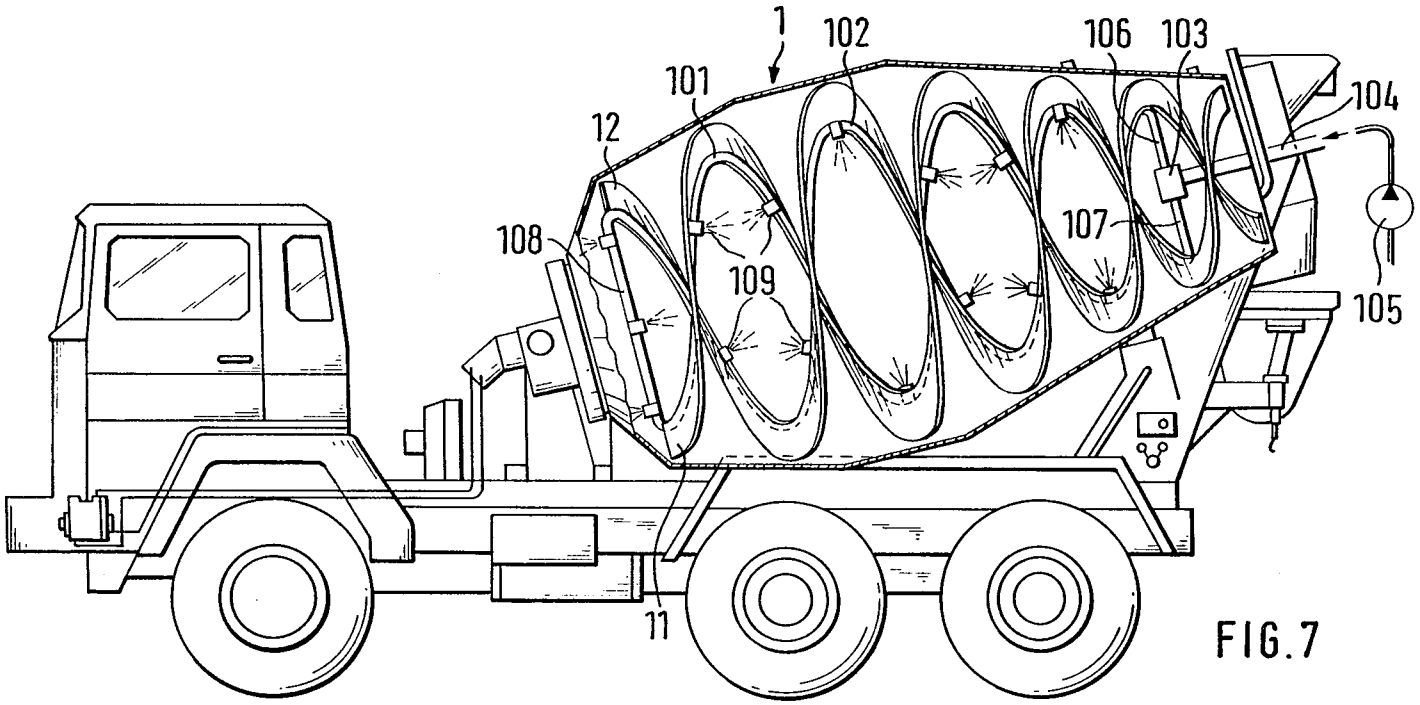
FIG. 7 shows a highway transport mobile mixer having a drum according to FIG. 4 (without counterflow spirals) with the interior of the drum being shown.

A modified embodiment of the invention is shown in FIG. 7. In the drum 1, only the mixing spirals 11 and 12 are fixed to the drum wall 9. Pipes 101 and 102 following the course of the end faces of the mixing spirals 11 and 12, which end faces face toward the drum center, connect nozzles 109 to one another which are arranged in uniformly distributed manner over the length of the mixing spirals 11 and 12. At the same time, the nozzles 109 are aligned in such a way that their openings lie in the mixing flow path during the mixing operation and therefore, an undisturbed delivery of the mixing water is ensured. The pipes 101 and 102 are connected to one another on the one hand via the pipe 108 and on the other hand via the pipes 106 and 107 with the pipes 106 and 107 extending radially from a rotary transmission coupling 103 located in the drum 1, into which rotary transmission coupling 103 leads the supply line 104 which connects the nozzles 109 to a pump 105 outside the drum 1. Although the counterflow spirals 26 and 27 are missing, a considerably improved thorough mixing of the building material charge is nevertheless obtained by means of this arrangement.

I claim:

1. Mobile mixer, preferably having counterrotational emptying, for building materials, in particular concrete, in a mixing drum (1) which, on its inner wall (9), has one or more flat elevators (11, 12) following a helix and extending from the closed drum base (2) to the drum opening (3), which elevators (11, 12) are driven about the drum axis during rotation of the mixing drum (1) and drive the building material in front of the closed drum base (2) during transport and during mixing, with one or more flat sections (26, 27) which are helically curved about the mixing drum axis (4) being mounted for driving during the mixing drum rotation (5) in the mixing drum space enclosed by the elevations acting as mixing spirals (11, 12), which flat sections (26, 27) are arranged counterrotationally to the mixing spirals (11, 12) in such a way that, during the transport and during the mixing of the building material (13), they produce a counterflow in the building material filling core surrounded by the mixing spirals (11, 12), wherein the flat sections (26, 27) start from the mixing drum base (2) and end in front of the mixing spirals (11, 12) and the mixing drum opening (3), and wherein the flat sections (26, 27) of the counterflow spirals are mounted to the elevators of the mixing spirals (11, 12) and via the mixing drum base (2) to the mixing drum wall (9).

2. Mobile mixer as claimed in claim 1, wherein the counterflow spirals (26, 27) have approximately the same pitch as the mixing spirals (11, 12).

3. Mobile mixer as claimed in claim 1, wherein the width of the flat sections forming the counterflow spirals (26, 27) is less than the width of the elevators (11, 12) on the mixing drum wall (9) which form the mixing spirals (11, 12)

4. Mobile mixer as claimed in claim 1, wherein nozzles (109) for delivering mixing water are arranged in the inside of the mixing drum (1), which nozzles (109) are connected to one another via pipelines (101, 102; 106, 107; 108) and are connected to a pump (105) arranged outside the drum (1), with the nozzles (109) being directed in such a way that their openings lie in the mixing flow path during the mixing operation of the drum. (1).

5. Mobile mixer as claimed in claim 4, wherein the nozzles (109) are arranged on the end faces of the flat sections (26, 27) which point toward the drum wall (9), and the pipelines (101, 102) follow the course of the flat sections (26, 27) and, at their ends, lead in each case into a pipe piece (106, 107, 108) running in a plane which is radial to the drum longitudinal axis, with one of the pipe pieces being connected to a supply line (104) which leads to the pump (105) via a rotary transmission coupling (103) in one of the front sides (2, 3) of the drum.

6. Mobile mixer, preferably having counterrotational emptying, for building materials, in particular concrete, having a mixing drum (1) which, on its inner wall, has one or more flat elevators (11, 12) following a helix and extending from the closed drum base (2) to the drum opening (3), which elevators (11, 12) are driven about the drum axis during rotation of the mixing drum (1) and drive the building material to the front of the closed drum base (2) during transport and during mixing, wherein nozzles (109) are arranged on the end faces of the mixing spirals (11, 12), which end faces point toward the drum center and which nozzles (109) are connected to one another by pipes (101, 102, 108), following the course of the mixing spirals (11, 12), and are connected by a supply line (104) to a pump (105) via pipelines (106, 107) and a rotary transmission coupling (103) which is arranged on one of the front sides (2, 3) of the drum (1), with the nozzles (109) being directed in such a way that their openings lie in the mixing flow path during the mixing operation of the drum (1).

7. Mobile mixer as claimed in claim 5, wherein the nozzles (109) are covered with hollow-shaped, wear-resistant caps which are made of an elastic or an elastomer material and in which slot-shaped openings are provided.

8. Mobile mixer as claimed in claim 5, wherein the rotary transmission coupling (103) has several channels, with each channel being fed in each case by one pump (105) and the channels are connected behind the rotary transmission on coupling (103) via individual lines to certain delivery nozzles (109).

9. Mobile mixer as claimed in claim 1, wherein the mixing drum (1) is inclined upwards and mounted on the chassis of a transporting vehicle (14) with the base (2) located at the bottom and the opening (3) located at the top.

10. Mobile mixer as claimed in claim 1, wherein the mixing drum (48) is mounted horizontally on the chassis (44) of a vehicle and the mixing drum base (2) as well as the mixing drum opening (54) can be closed with lids (53, 55).

11. Mobile mixer as claimed in claim 10, wherein the filling opening (54) is arranged in the end wall of the drum (1, 1', 1''), which end wall is opposite the drum end wall (2) on the discharge side and to which end wall a filling funnel (217) can be fixed which extends with a chute (216) into the filling opening (54).

12. Mobile mixer as claimed in claim 11, wherein the filling funnel (217), with conical projections (221) arranged on it, can be locked in two or more likewise conical sleeves (222) which are arranged on the chassis (44) of the vehicle.

13. Mobile mixer as claimed in claim 2, wherein the width of the flat sections forming the counterflow spirals (26, 27) is less than the width of the elevators (11, 12) on the mixing drum wall (9) which forms the mixing spirals (11, 12).

14. Mobile mixer as claimed in claim 2 wherein nozzles (109) for delivering the mixing water are arranged in the inside of the mixing drum (1), which nozzles (109) are connected to one another via pieplines (101, 102; 106, 107; 108) and are connected to a pump (105) arranged outside the drum (1), with the nozzles (109) being directed in such a way that their openings lie in the mixing flow path during the mixing operation of the drum (1).

15. Mobile mixer as claimed in claim 3 wherein nozzles (109) for delivering the mixing water are arranged in the inside of the mixing drum (1), which nozzles (109) are connected to one another via pipelines (101, 102; 106, 107; 108) and are connected to a pump (105) arranged outside the drum (1), with the nozzles (109) being directed in such a way that their openings lie in the mixing flow path during the mixing operation of the drum (1).

16. Mobile mixer as claimed in claim 6 wherein the nozzles (109) are covered with hollow-shaped, wear-resistant caps which are made of an elastic or an elastomer material and in which slot-shaped openings are provided.

17. Mobile mixer as claimed in claim 6 wherein the rotary transmission coupling (103) has several channels, with each channel being fed in each case by one pump (105) and the channels are connected beind the rotary transmission on coupling (103) via individual lines to certain delivery nozzle (109).

18. Mobile mixer as claimed in claim 5 wherein the mixing drum (1) is inclined upwards and mounted on the chassis of a transporting vehicle (14) with the base (2) located at the bottom and the opening (3) located at the top.

19. Mobile mixer as claimed in claim 17 wherein the mixing drum (1) is inclined upwards and mounted on the chassis of a transporting vehicle (14) with the base (2) located at the bottom and the opening (3) located at the top.

20. Mobile mixer as claimed in claim 5 wherein the mixing drum (48) is mounted horizontally on the chassis (44) of a vehicle and the mixing drum base (2) as well as the mixing drum opening (54) can be closed with lids (53, 55).

21. Mobile mixer as claimed in claim 17 wherein the mixing drums (48) is mounted horizontally on the chassis (44) of a vehicle and the mixing drum base (2) as well as the mixing drum opening (54) can be closed with lids (53, 55).

22. A mobile mixer and transporter for building materials such as concrete, said mixer having an elongated drum and a wheel supported mount therefor, means on said mount for rotating said drum about its longitudinal axis, said drum having first and second ends; a pair of helical primary blades secured to and adjacent the walls of said drum and forming an annulus within said drum, the direction of spiral of said primary blade being such that when said drum is rotated in one direction said primary blade will move material in said drum toward said second end, the improvement in said mixer comprising: a pair of helical secondary blades having a direction of spiraling opposite to that of said primary blades; said secondary blades being supported on said primary blades and forming an annulus within the central opening of said primary blades; the spiral formed by said secondary blades having an outer diameter smaller than the inner diameter of the spiral formed by said primary blades whereby an annular space is provided between said primary and secondary blades, said primary blades extending substantially to the first end of the drum and said secondary blades terminating short of said primary blades adjacent said first end whereby they will discharge material into said primary blades for entrainment thereby, said secondary blades extending to the second end of said drum for entraining material moved to said second end by said primary blades for causing the material to counterflow from said second end and be discharged adjacent said first end.

23. A mobile mixer and transporter as described in claim 22 wherein a conduit for liquids is mounted on the edge of the blades of one of said primary and secondary blades, discharge nozzles mounted on said conduit at spaced intervals therealong, said discharge nozzles on said conduit having orifices for discharging liquid into the material being moved by said primary and secondary blades.

24. A mobile mixer and transporter as described in claim 23 wherein said conduit is mounted on the inner edge of said primary blade.

25. A mobile mixer and transporter as described in claim 23 wherein said conduit is mounted on the outer edge of said secondary blade.

26. A mobile mixer and transporter as described in claim 23 wherein the discharge orifices of said nozzles are directed generally radially into the annular area between the inner edge of the primary blade and the outer edge of the secondary blade.

27. A mobile mixer and transporter for building materials such as concrete, said mixer having an elongated drum and a wheel supported mount therefor, means on said mounted for rotating said drum about its longitudinal axis, said drum being generally frustoconical in shape having a large diameter closed end and a small diameter open end; a pair of helical primary blades within, secured to and adjacent the walls of said drum and forming an annulus within said drum, the direction of spiraling of said primary blade being such that when said drum is rotated in one direction said primary blade will move material in said drum toward said closed end, the improvement in said mixer comprising: a pair of helical secondary blades having a direction of spiralling opposite to that of said primary blades; said secondary blades being supported on said primary blades and forming an annulus within the central opening of said primary blades; the spiral formed by said secondary blades having an outer diameter smaller than the inner diameter of the spiral formed by said primary blades whereby an annular space is provided between said primary and secondary blades, said primary blades extending substantially to the open end of the drum and said secondary blades adjacent said open end terminating short of said primary blades whereby they will discharge material into said primary blades for entrainment thereby, said secondary blades extending to the closed end of said drum for entraining material moved to said closed end by said primary blades for causing the material to counterflow from said closed end and discharging it adjacent said open end.

28. A mobile mixer and transporter as described in claim 27 wherein means are provided for supporting said secondary blades on said primary blades.

29. A mobile mixer and transporter as described in claim 27 wherein said secondary blades are shaped to define an annular spiral having a circular portion at the center of the interior of said drum structure, said portion being of progressively smaller diameter toward said open end.

30. A mobile mixer and transporter as described in claim 27 wherein a conduit for liquids is mounted on the edge of one of said primary and secondary blades, said edge being the one facing into the space between said blades; discharge nozzles mounted on said conduit at spaced intervals, said nozzles having orifices for discharging liquid into the material being moved by said primary and secondary blades.

31. A mobile mixer and transporter as described in claim 30 wherein the discharge orifices of said nozzles are directed generally radially into the annular area between the inner edge of the primary blade and the outer edge of the secondary blade.

32. A mobile mixer and transporter as described in claim 30 wherein shields are mounted adjacent each nozzle upstream of the direction of movement of the material past the nozzle for protecting the nozzle from the abrasive and sealing effects of the moving material.

33. A mobile mixer and transporter as described in claim 30 wherein said conduit is mounted on the inner edge of said primary blade.

34. A mobile mixer and transporter as described in claim 30 wherein said conduit is mounted on the outer edge of said secondary blade.

* * * * *

UNITED STATES PATENT AND TRADEMARK OFFICE

CERTIFICATE OF CORRECTION

PATENT NO. : 4,730,934

DATED : March 15, 1988

INVENTOR(S) : Gerhard Schwing

It is certified that error appears in the above-identified patent and that said Letters Patent is hereby corrected as shown below:

Column 13, line 66, delete "beind", and insert --behind--.

Column 13, line 68, delete "nozzle", and insert --nozzles--.

Column 14, line 17, delete "drums" and insert --drum--.

Column 14, line 28, delete "spiral" and insert --spiraling--.

Column 15, line 4, delete "mounted" and insert --mount--.

Column 15, line 14, delete "spiralling" and insert --spiraling--.

Signed and Sealed this

Second Day of August, 1988

*Attest:*

DONALD J. QUIGG

*Attesting Officer*

*Commissioner of Patents and Trademarks*